US006036240A

United States Patent [19]

Hamilton et al.

[11] Patent Number: 6,036,240

[45] Date of Patent: Mar. 14, 2000

[54] BOLT SEAL LOCK DEVICE

[75] Inventors: Craig Hamilton, Waterloo; David L. Stevenson; Terrence N. Brammall, both of Angola, all of Ind.

[73] Assignee: Tranguard Industries, Inc., Angola, Ind.

[21] Appl. No.: 09/073,543

[22] Filed: May 6, 1998

[51] Int. Cl.[7] ..... E05C 3/04

[52] U.S. Cl. ..... 292/202; 292/302; 292/150; 70/417; 70/104

[58] Field of Search ..... 292/202, 302, 292/150, 283, 207, DIG. 32, DIG. 55; 70/417, 104, 102

[56] References Cited

U.S. PATENT DOCUMENTS

| | | | |
|---|---|---|---|
| 1,834,678 | 12/1931 | Bryant | 292/283 |
| 3,736,674 | 6/1973 | Enters | 37/43 R |
| 3,951,443 | 4/1976 | Barnaby | 292/327 |
| 4,015,868 | 4/1977 | Buttler | 292/302 |
| 4,033,155 | 7/1977 | DeLucia | 70/56 |
| 4,813,254 | 3/1989 | Foshee | 70/104 |
| 4,844,519 | 7/1989 | Dagon | 292/57 |
| 4,852,920 | 8/1989 | DeForrest, Sr. | 292/205 |
| 4,898,008 | 2/1990 | Eberly | 70/56 |
| 5,118,149 | 6/1992 | Ermmons | 292/327 |
| 5,146,771 | 9/1992 | Loughlin | 70/56 |
| 5,255,542 | 10/1993 | Fortin | 70/34 |
| 5,347,689 | 9/1994 | Georgopoulos et al. | 24/136 R |
| 5,413,393 | 5/1995 | Georgopoulos et al. | 292/327 |
| 5,477,710 | 12/1995 | Stefanutti | 70/56 |
| 5,544,506 | 8/1996 | Nakano | 70/34 |
| 5,775,747 | 7/1998 | Navarsky | 292/307 B |
| 5,832,756 | 11/1998 | Herman, Jr. | 70/131 |
| 5,857,721 | 1/1999 | Liroff | 292/307 R |

FOREIGN PATENT DOCUMENTS

| | | | |
|---|---|---|---|
| 21913 | 8/1947 | Finland | 292/302 |

*Primary Examiner*—B. Dayoan
*Assistant Examiner*—Clifford B Vaterlaus
*Attorney, Agent, or Firm*—William Squire

[57] ABSTRACT

Two mating L-shaped steel sheet casing members in one embodiment for sliding doors are secured to a corresponding door and have overlying front walls in the closed state. Each member has a plurality of corresponding locking keeper elements. In the closed state the keeper elements are in interdigitated juxtaposed and preferably welded to the casing members via through optional bores in the casing members, or extend through the side walls of the casing formed by side wall sections. The keeper elements in one subassembly are slotted to allow for misalignment with the other keeper elements for receiving a locking bolt seal shaft. The keeper elements optionally have tongue projections for engaging a gap between the closed doors. An angle iron member shields the rear of the chamber below the lowermost locking element to protect the seal locking body. Other embodiments are disclosed and include cast assemblies with no weldments and a single casing and hasp for use with swinging doors or a rail car plug door. The casing includes keeper elements which receive hasp-like keeper elements attached to a door and which mate in the closed state with the hasp attached to a support in interdigitated relation.

29 Claims, 7 Drawing Sheets

BOLT SEAL LOCK DEVICE

This invention relates to bolt seals and lock devices therefor, and more particularly, to a device for bolt seals used to secure rail car doors and truck doors and the like.

Of interest are commonly owned copending application Ser. No. 909247 entitled "Protection Device for Bolt Seal and Hasp" filed Aug. 11, 1997 in the name of Robert E. Stone et al., U.S. Pat. Nos. 5,413,393 and 5,347,689, both in the name of Georgopoulos et al. now U.S. Pat. Nos. 5,878,684 and 5,732,989 in the name of David L. Stevenson et al., all incorporated by reference herein.

Cargo shipping vehicles and containers, and in particular, rail cars, especially those shipping automobiles, are subject to widespread tampering due to the value of the cargo. Thieves break open conventional bolt seals which comprise a steel bolt shaft to which a head is swaged at one end and to which a locking body containing a lock mechanism is locked at the other end. The shafts are subject to relatively easy tampering by way of bolt cutters or cutting torches.

U.S. Pat. No. 5,413,393 illustrates a bolt seal and a tool for breaking the shaft at the head end of the shaft. The tool engages the head and manually bends the shaft which breaks due to serrations in the shaft. In the aforementioned copending application, a locking seal employs a steel bolt with a head at one end and grooves along the bolt shaft for use with a locking body containing a releasable locking mechanism which engage the grooves. The mechanism is released by a disclosed mating specially designed tool and which locking body mechanism is otherwise difficult to release and is relatively tamper resistant. U.S. Pat. No. 5,347,689 shows a further bolt seal configuration using a bolt and locking body and which requires a tool similar to the tool of the '393 patent tool to break the seal shaft. Other seals are known wherein tool cutters are required to cut the bolt shaft.

In U.S. Pat. No. 5,118,149, a container hasp protector is disclosed. A metal box-like body has a top plate, a bottom plate, right and left side plates, an open rear face and a front face. A shield plate is on the front face and extends between the side plates forming a top opening in the face between the shield plate and top plate and a bottom opening in the face between the shield plate and the bottom plate. The body is arranged to protect the hasp from intentional breakage. The shield plate has an aperture which cooperates with aligned apertures in a hasp to receive a breakaway security seal. The problem with this device as recognized by the present inventors is that while the hasp is protected, the shaft of the seal is exposed via the openings in the front face. These openings are provided so that an authorized user can break the seal by cutting the shaft. The problem is that the exposed shaft permits tamperers to use bolt cutters or torches to readily cut the seal shaft.

The present inventors recognize that potential thieves do not like to tamper with locks that are difficult to open, especially locks on cargo doors which may be subject to periodic surveillance. If the locks can not be opened in a few minutes, thieves are likely to pass up such tampering. For this reason the device of the '149 patent is believed not desirable for valuable cargo containers and the like.

U.S. Pat. No. 3,951,443 discloses a security lock that employs a locking pin. The lock employs interengaged keepers with aligned through apertures which receive the pin. One of the keepers has a through pilot hole in the face thereof so that the pin can be cut apart with a heavy duty power drill for use by an authorized person. The lock is opened by destroying the pin. It is disclosed that thieves would not like to use a noisy, inconvenient and conspicuous power drill. However, portable cutting torches may also be used to cut the pin via the pilot hole. This is believed unsatisfactory.

Padlock protector devices are disclosed in U.S. Pat. Nos. 4,898,008, 4,033,155, 5,146,771, and 5,477,710. These also are not satisfactory for cargo shipping containers or rail cars because the shackles are readily exposed for destruction by a tamperer. Further these devices are not disclosed as operative with bolt seals of the type described above.

The present inventors recognize a need for a cost effective seal and lock device which uses cost effective reusable locking bodies or reusable bolts and locking bodies. They recognize a need for a locking device which precludes access to the bolt shaft which is vulnerable to tampering.

A seal protective and locking device according to one aspect of the present invention is for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween.

The device comprises a casing comprising at least one casing member forming a chamber in at least the closed state and for fixed attachment to at least one of the door and support, the casing in cooperation with the at least one door and support in at least the closed state precluding passage of tampering tools therethrough. A first locking keeper element is secured to the casing and having a first bolt seal receiving aperture.

A second locking keeper element has a second bolt seal receiving aperture for being secured to the other of the door and support, the second keeper element for selectively overlying the first keeper element in the chamber in the closed state of the door and support such that the bolt seal apertures are aligned for receiving the seal shaft, the head and locking body for selective locking of the overlying locking keeper elements to the shaft, the keeper elements and casing being arranged so that the shaft portion is enclosed in the chamber and is inaccessible through the casing and through the locking keeper elements at the head and locking body ends of the shaft.

In a further aspect, the casing has two opposing side walls and a front wall, the side walls each having a portion depending beneath the lowermost of the keeper elements forming a chamber portion therebetween, further including a shield member in the chamber portion secured to at least one of the side walls, casing and first keeper element, the shield member for shielding the rear of the chamber portion opposite the plane of the front wall from penetration therethrough by the tampering tools.

In a further aspect, the door and support in the closed state exhibit a gap therebetween, the locking keeper elements each including a tongue projection in overlying relation in the closed state for extending in the gap.

The casing in a still further aspect may comprise first and second mating casing members each for being secured to a different one of the door and support, the casing members forming the chamber when mated in the closed state, the first keeper element being secured to the first casing member and the second keeper element being secured to the second casing member.

The first and second casing members in a further aspect form corresponding first and second portions of the chamber, the first keeper element being located in the first chamber portion and the second keeper element being located in the second chamber portion.

The casing members and locking keeper elements may be metal, the casing members each having a plurality of weld apertures therethrough aligned with and corresponding to each locking element, and a weld joint in each weld aperture between each of the keeper elements and the respective corresponding casing member.

When the casing comprises first and second mating casing members, each member may be secured to a different one of the door and support, the first and second casing members each including a front wall section, the front wall sections of the members including portions which overly each other in the closed state.

The device may include a plurality of the first and second locking keeper elements, the second locking keeper elements for being between at least a portion of the first keeper elements in the closed state of the door and support, the seal receiving apertures of the second keeper elements each comprising a slot aligned in overlying relation with each other and with the seal apertures in the first keeper elements.

The device may also in a further aspect include a plurality of the first and a plurality of the second keeper elements, the first elements being secured to the first casing member, the second elements being secured to the second casing member, each the casing members having a side wall, each the side wall comprising a plurality of side wall sections alternating with and secured to the keeper elements of that casing member to form a continuous side wall with the alternating keeper elements. The keeper elements at each side wall may project beyond the side wall sections.

The keeper elements in a further aspect each have a front edge facing a front wall section of the corresponding casing member, the front wall section of one casing member having a portion spaced from the front edge of its corresponding keeper elements forming a slot therebetween, the slot for receiving the front wall section of the other casing member in the closed state.

The casing in a still further aspect comprises a front wall and opposing side walls forming the chamber, the first keeper element being secured in the chamber, further including third and fourth keeper elements secured to the casing, each element with a seal receiving aperture respectively forming a top and a bottom wall of the chamber, the second keeper element for being received between the first keeper element and one of the third and fourth keeper elements with all the apertures being aligned in the closed state of the support and door.

IN THE DRAWING

FIG. 1 is an isometric view of a bolt seal locking device and bolt seal locked thereto for locking a pair of sliding doors, shown in phantom, closed according to one embodiment of the present invention;

FIG. 1*a* is an isometric view of the bolt seal locking device assembly of FIG. 1 partially in section for illustrating the bolt seal;

Figure 13A:
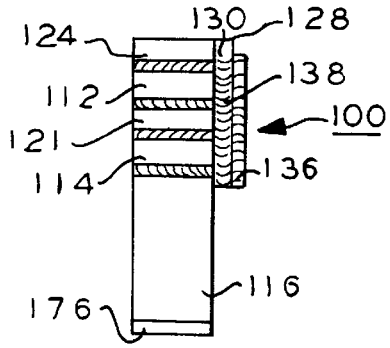
Figure 13B:
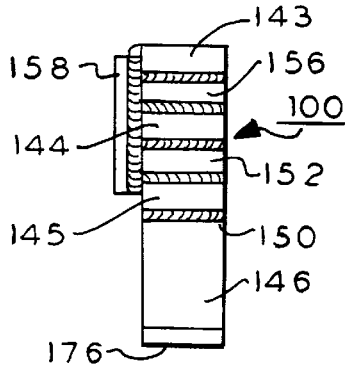
Figure 15:
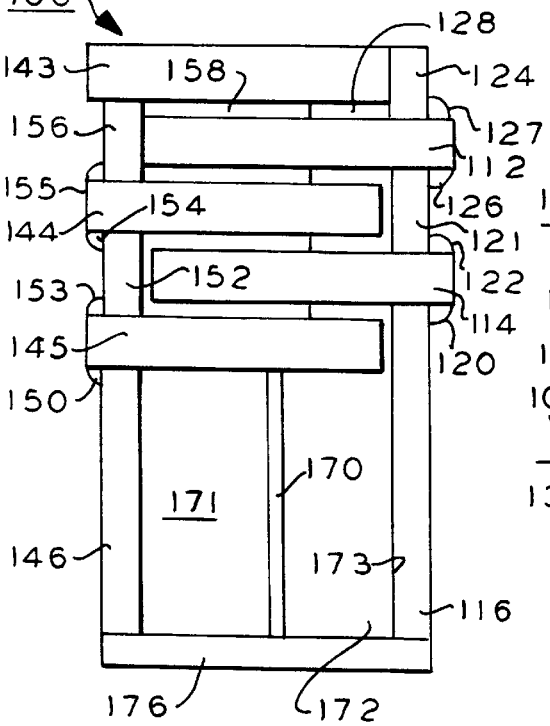
Figure 15A:
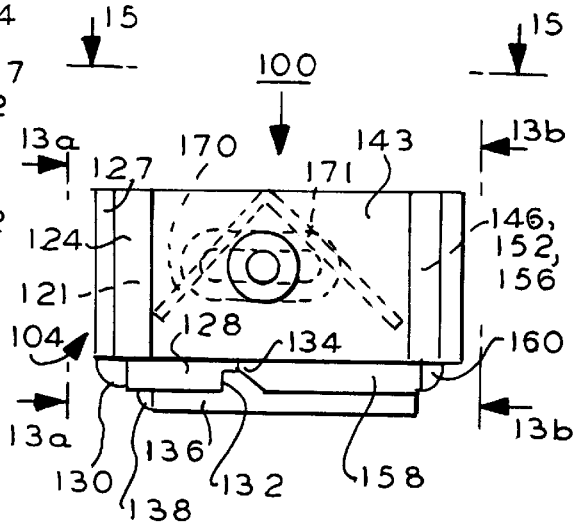

FIGS. 13*a* and 13*b* are side elevations views of the device of FIG. 15*a* taken along respective lines 13*a*—13*a* and 13*b*—13*b;*

Figure 10:
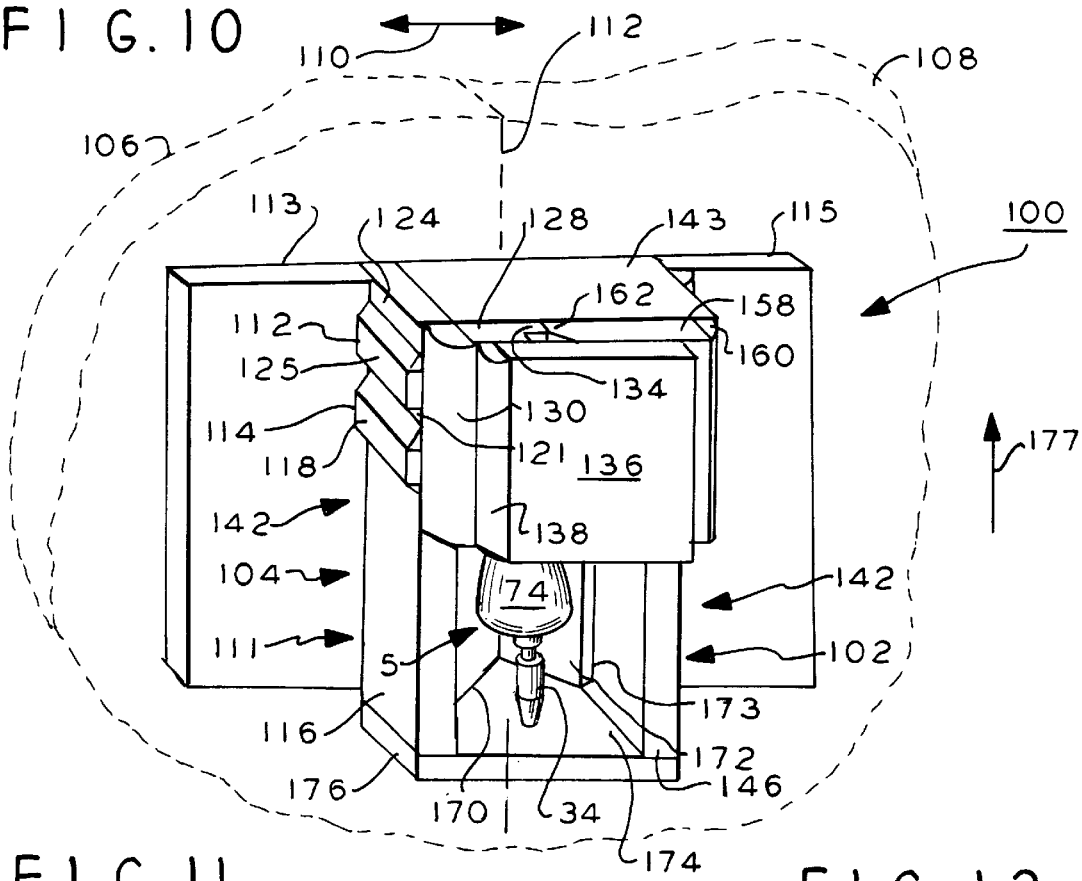
FIG. 10 is an isometric view of a bolt seal locking device according to a second embodiment of the present invention with the attached sliding doors shown closed and in phantom.
Figure 14:
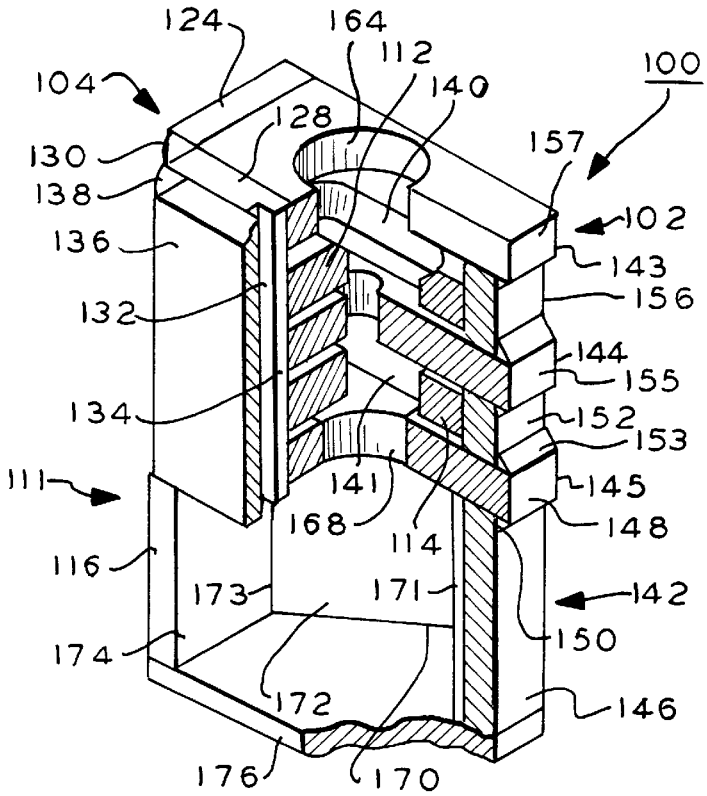
Figure 16:
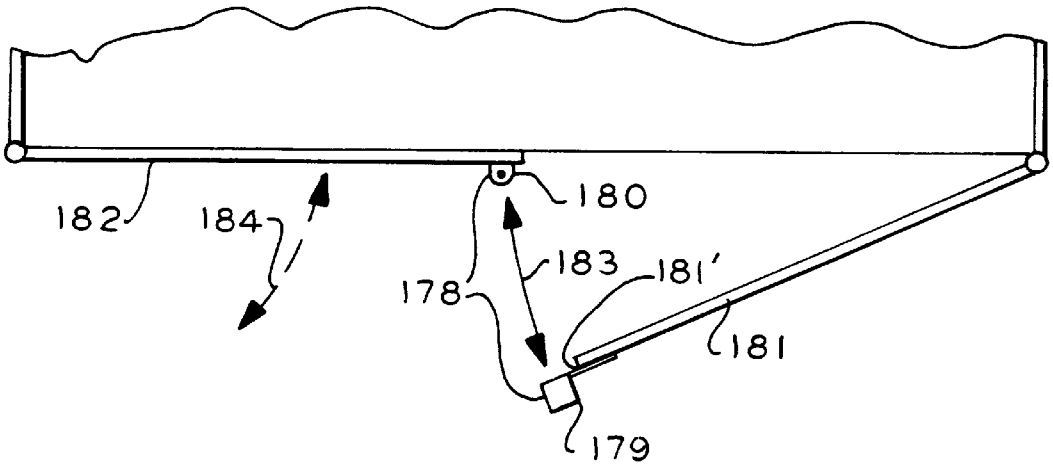
Figure 17:
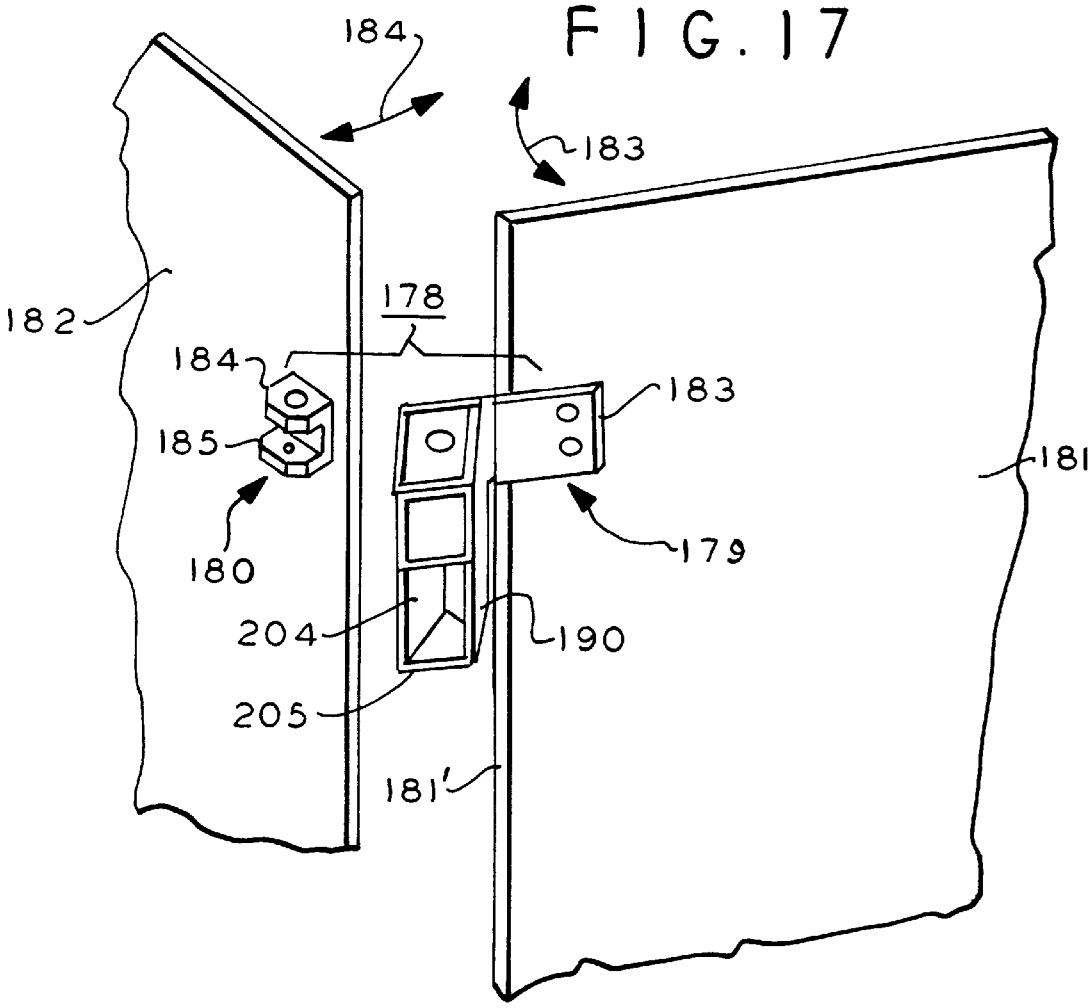
Figure 18:
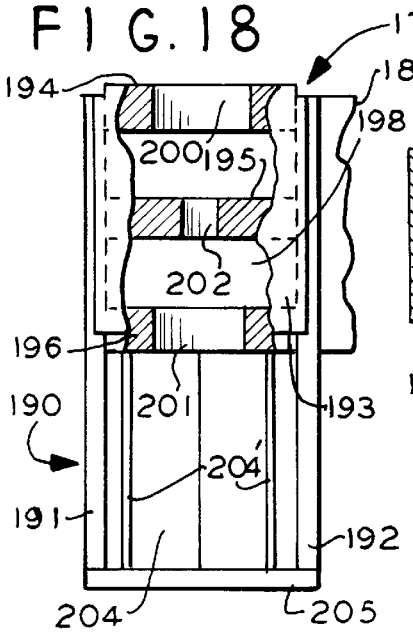
Figure 19:
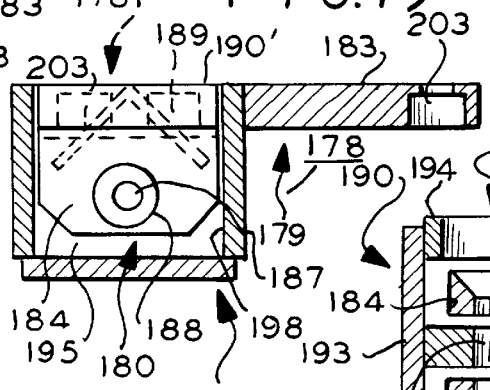
Figure 20:
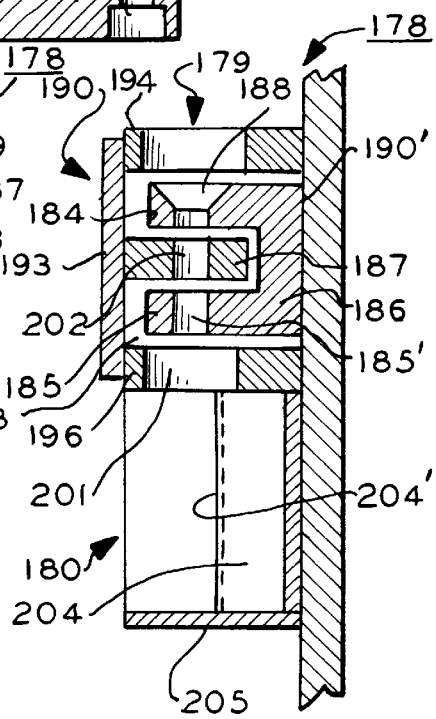
Figure 21:
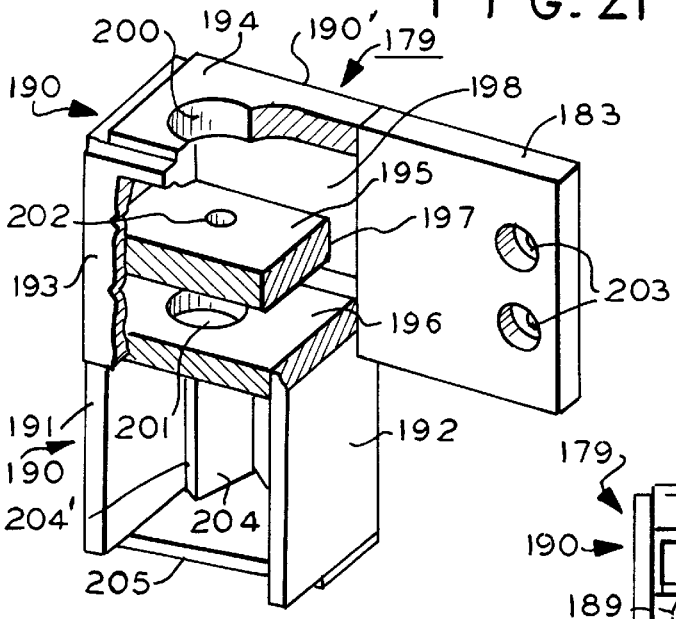
Figure 22:
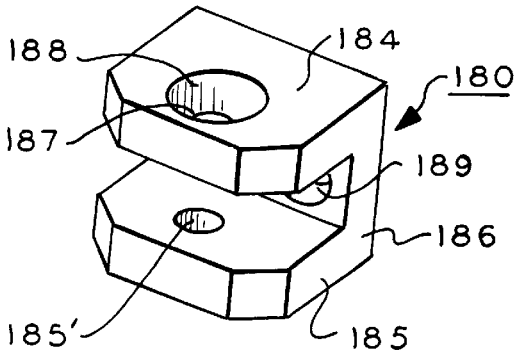
Figure 23:
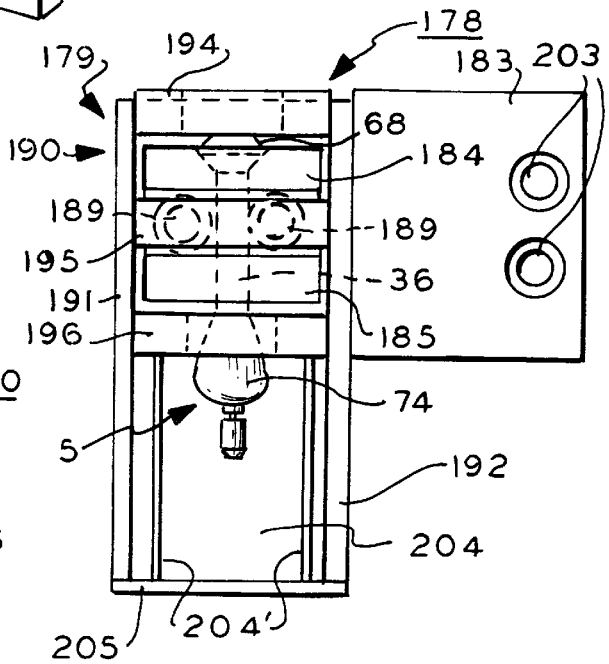
Figure 24:
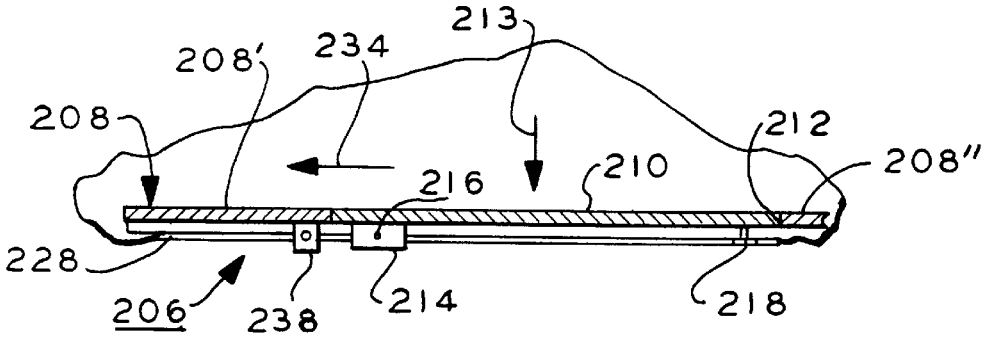
Figure 25:
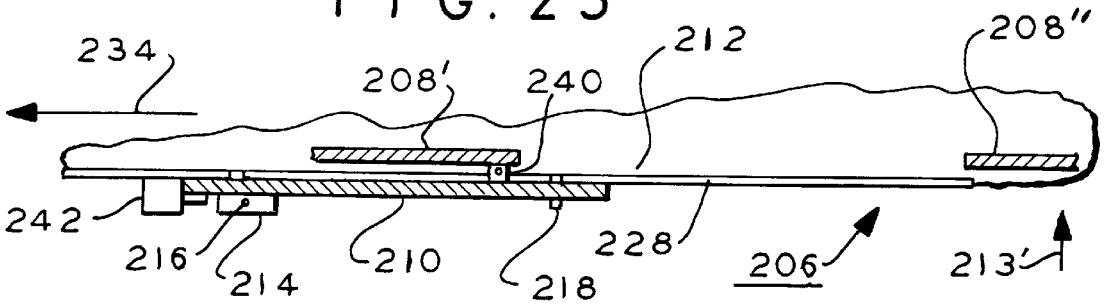
Figure 26:
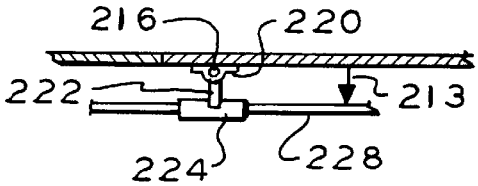
Figure 27:
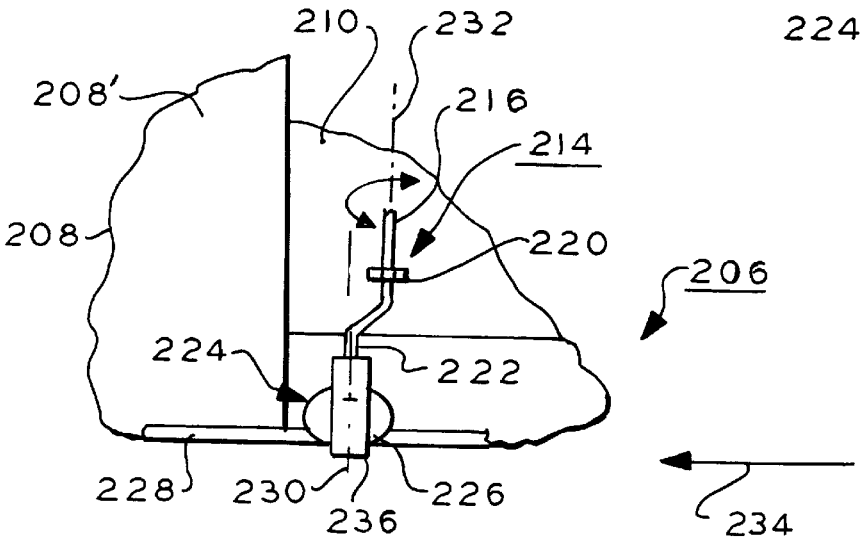

FIG. 14 is a partially in section isometric view illustrating in more detail the device of FIG. 10 without the bolt seal;

FIG. 15 is a rear elevation view of the device of FIG. 15*a* taken along lines 15—15;

FIG. 15*a* is a top plan view of the device of FIG. 10;

FIG. 16 is a top plan fragmented view of a swing door assembly employing a locking device according to a third embodiment of the present invention;

FIG. 17 is an isometric view of the door portion of the assembly of FIG. 16 with both doors partially open;

FIG. 18 is a front fragmented elevation view partially in section of a locking device female member of the embodiment of FIGS. 16 and 17;

FIG. 19 is a plan top sectional view of the locking device of FIGS. 16 and 17 in an assembled state without a locking seal in place;

FIG. 20 is a side elevation sectional view of the assembled device of FIG. 19;

FIG. 21 is an isometric view partially in section of the device female member of FIG. 18;

FIG. 22 is an isometric view of the male member of the device of FIG. 20;

FIG. 23 is a front elevation view of the assembly of FIG. 20 with the front plate of the female member removed;

FIGS. 24 and 25 are top plan sectional views of a rail car plug door in respective open and closed states for use with the device of FIGS. 16–23;

FIG. 26 is a top plan sectional diagrammatic view of a portion of the door of FIG. 24; and FIG. 27 is a fragmented side elevation view of a portion of the plug door of FIGS. 24–26 showing a portion of a crank mechanism used to open and close the door.

Figure 1:
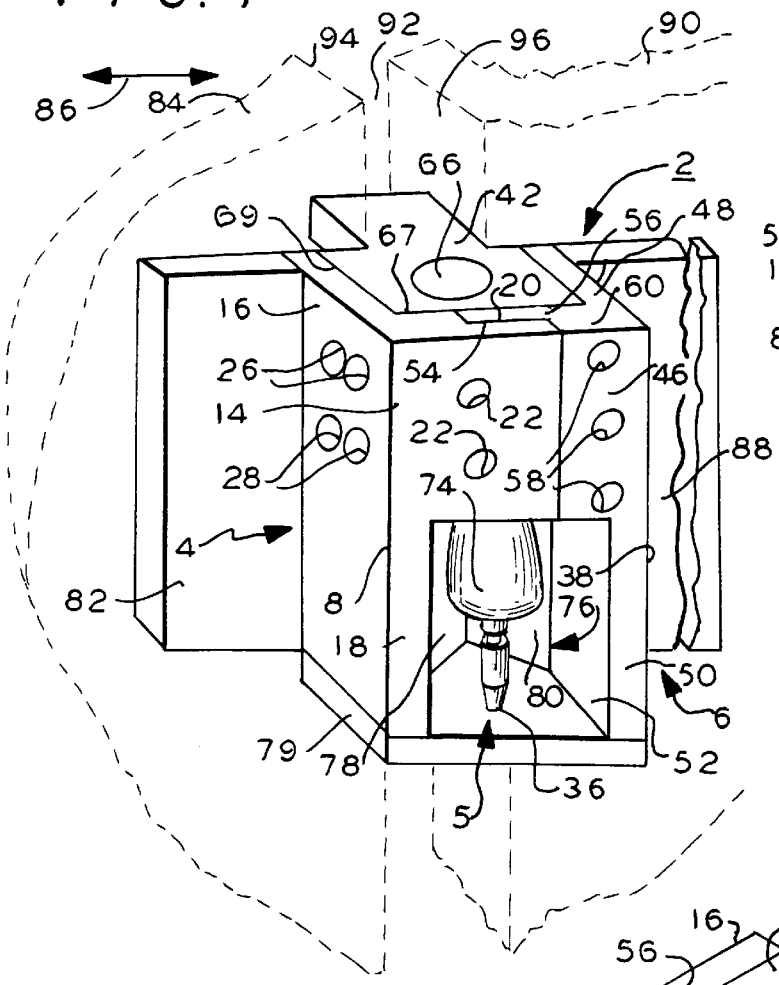
Figure 1A:
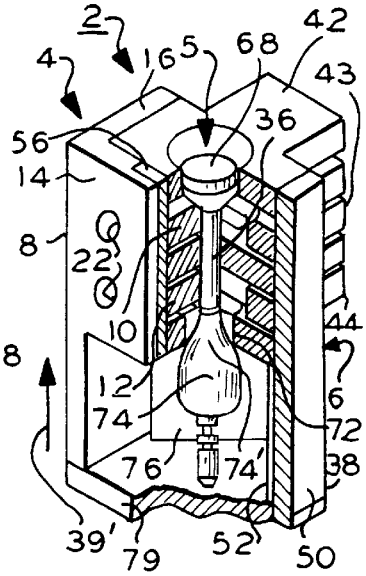

In FIGS. 1 and 1*a*, lock device 2 comprises two mating complementary subassemblies 4 and 6 secured by a bolt seal 5. Seal 5 may be any configuration, but is preferably a releasable unit as described more fully in the aforementioned U.S. Pat. No. 5,732,989 incorporated by reference herein.

Figure 9:
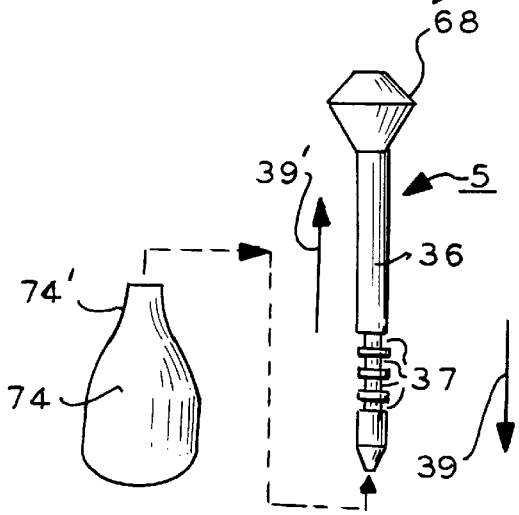
FIG. 9 is a side elevation view of a representative bolt seal used in the embodiment of FIGS. 1 and 1*a;*

The following is a brief description of the seal 5, FIG. 9, as disclosed in the aforementioned copending application. Seal 5 comprises a shank 36, a head 68 permanently secured to the shank and a locking body 74 including radially and axially spring loaded jaws (not shown). These jaws radially resiliently releasably engage and lock to a selected groove 37 in the shank. These jaws automatically engage an aligned shank groove 37 when the locking body 74 is attached to the shank 36 in an axial direction 39'.

The body 74 jaws are spring loaded radially inwardly by a relatively weak circumferential ring spring (not shown) such as an O-ring or a split metal ring spring. The body jaws resiliently engage and disengage each of the grooves 37 as the locking body is axially displaced in direction 39.

To permit such disengagement, the jaws have two axially spaced parallel frusto-conical surfaces, one of which is radially interior and the other radially exterior. The jaws along these surfaces are provided a radially outward annular ramped path inclined relative to and generally along direction 39. The path is provided by a first annular intermediate member (not shown) with a first frusto-conical ramp surface which mates with the radially interior frusto-conical jaw surface and by a second annular intermediate member (not shown) with a second frusto-conical ramp surface which mates with the radially exterior frusto-conical jaw surface.

The jaws may comprise three annular split segments (not shown). The jaws displace radially outwardly in a direction inclined relative to and generally in direction 39 along the path in response to an insertion force, direction 39', imposed by the shank 36 against the jaws as the locking body moves along the shank 36, direction 39.

Once the locking body 74 jaws are engaged with a desired shank groove 37, the body 74 can not be removed from the shank 36 in the opposite direction 39. The body 74 jaws are normally locked from radial outward displacement normal to direction 39 by an outer cylindrical member, the second intermediate member, that is axially displaceable. This radial jaw locking action is provided by the second intermediate member second surface. This member also has a cylindrical portion surrounding the jaws axially engaging the first intermediate member. The second member second frusto-conical locking surface surrounds and radially engages the mating external frusto-conical surface on the locking body 74 jaws. These latter surfaces radially inwardly lock the locking body jaws normal to direction 39.

The body 74 jaws are locked radially inwardly by a very high spring constant compression spring force (not shown), e.g., 300 lb., in direction 39. The spring axially engages the second intermediate member forcing it in direction 39 against the first member and the locking body 74 housing. The frusto-conical locking surface of the second intermediate member is highly spring loaded radially against the locking body jaws mating exterior frusto-conical surface, locking the jaws radially inwardly against the engaged groove 37.

To release the body 74 jaws, a tool (not shown) with manually operated highly leveraged locking body engagement jaws (not shown) has a cylinder (not shown) pivotally attached to one of the tool jaws. The tool jaws squeeze the locking body therebetween so that the cylinder, which has a bore for receiving the seal shank 36 therethrough, axially engages and displaces the locking body first intermediate member in direction 39'.

The first intermediate member then axially engages and displaces the second intermediate member in direction 39'. This causes the second intermediate member to compress the high spring force spring in direction 39'. The second member also axially displaces an amount in direction 39' sufficient to radially release its frusto-conical locking surface from radial locking engagement with the exterior frusto-conical surface of the locking body jaws.

At the same time, the first intermediate member first frusto-conical cam surface is axially displaced in direction 39' engaged with the interior frusto-conical jaw surface. This cams the simultaneously freed jaws radially outwardly for release from the groove 37 releasing the locking body. The seal shank 36, head 68 and locking body 74 are all reusable requiring no destruction of any of the seal components.

The locking device 2 will now be described. Subassembly 4, FIG. 4, includes an L-shaped casing member 8 and an aligned array of preferably two T-shaped hasp locking keeper elements 10 and 12. In the alternative, one or more than two such locking keeper elements may be used according to a given implementation. The casing member 8 is preferably a right angle which may be ⅜ inch (9.5 mm) thick sheet steel. Member 8 has a front wall 14 and a lateral side wall 16. The side wall 16 has a portion 18 which depends below the lower edge 19, FIG. 6, of the front wall. The front wall 14 and the side wall 16 each are preferably rectangular. They may in the alternative be other shapes or be formed as a curved cylindrical or semi-spherical integral wall according to a given implementation.

Figure 6:
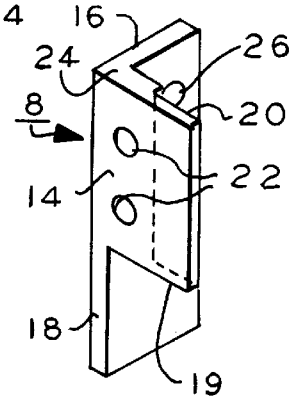
FIG. 6 is an isometric exterior view of the casing member of FIG. 4.

The front wall 14, FIG. 6, is formed with a rectangular recess 20 which extends for the length of the wall 14. The front wall 14 preferably has a pair of aligned through-bores 22, which may be one half inch diameter (12.7 mm) in the thicker wall portion 24 next to the recess 20. The side wall 16, FIG. 1, preferably has two adjacent pairs of through-bores 26, 28 of the same diameter as bores 22. The bores 26 are in one plane with the upper one of bores 22. The bores 28 are in a second parallel plane with the other lower one of bores 22.

Figure 4:
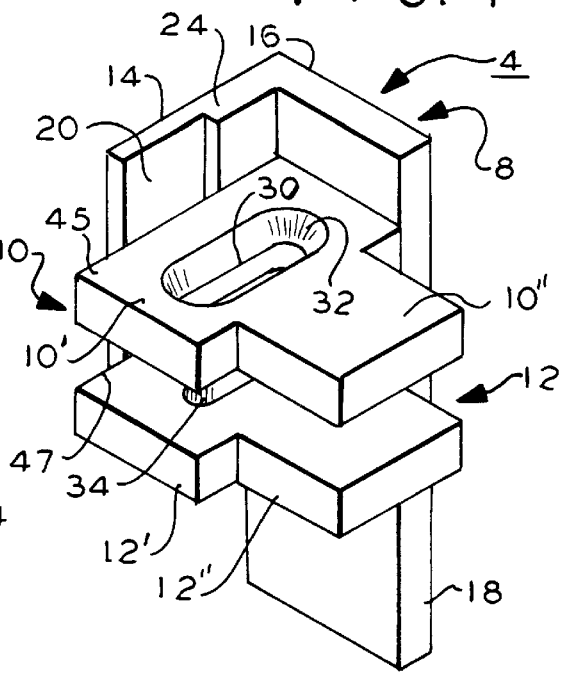
FIG. 4 is an isometric interior view of the left hand casing member portion of the device of FIG. 1 and associated locking keeper elements attached thereto.
Figure 7:
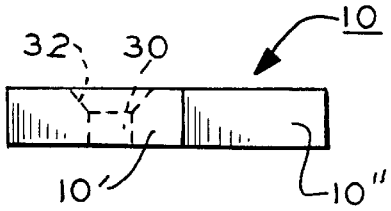
FIG. 7 is a side elevation view of a locking keeper element of FIG. 4.

Locking keeper elements 10 and 12, FIG. 4, are the same in thickness and in profile peripheral dimensions, and may be one half inch (12.7 mm) thick sheet steel. The keeper element 10, FIGS. 4 and 7, has a transverse cross head 10' from which a tongue projection 10" extends normal thereto forming a T shape. The tongue projection 10" may be 1.5 inches wide×1.25 inches deep (3.8 cm×3.2 cm). The head 10' may be 2.5 inches across in length×1.5 inches deep in width (6.4 cm×3.8 cm). The head 10' has an elongated slot 30 extending there across. The slot 30 preferably has a beveled or chamfered edge 32.

Figure 8:
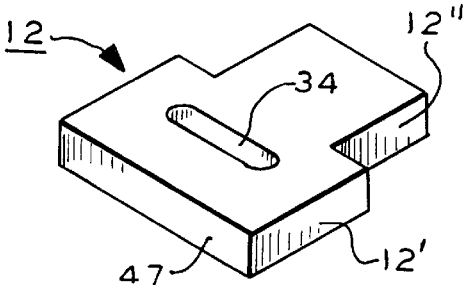
FIG. 8 is an isometric view of a further locking keeper element of FIG. 4.

The keeper element 12, FIGS. 4 and 8, has a transverse cross head 12' and a normal extending tongue projection 12" preferably identical in peripheral dimensions as keeper element 10. The head 12' has an elongated slot 34. The slots 34 and 30 are of the same length and are axially aligned one above the other in the Figures.

The keeper element 10 head 10' preferably has the same width as and abuts the side wall 16 of the casing member 8, FIG. 4. The head 10' abuts the casing member 8 front wall 14 thicker portion 24 so that recess 20 forms a slot between the head 10' and the front wall 14. A similar slot is between the keeper element 12 head 12' and casing member 8 front wall 14. These slots receive the reduced thickness portion 56 of the front wall 46 of the casing member 38, FIGS. 1 and 3.

The keeper element 10 is preferably welded to the casing member 8 front wall 14 via the upper bore 22, which bore is filled with weld material. Similar welds at bores 26 preferably secure the head 10' to the side wall 16. The bores 26 are preferably also filled by the welds. The weld filled bores preclude access therethrough by tampering tools to the interior chamber formed by the inner facing surfaces of the front wall 14 and side wall 16. These welds also permit the locking keeper elements of the two subassemblies 4 and 6 to interengage as in FIGS. 1*a* and 2 in close spaced relation which may comprise ⅛ inch (3.2 mm) spacings therebetween. The aligned slots 30 and 34 and keeper elements 10 and 12 form a hasp arrangement for receiving the bolt seal 5 shaft 36.

In the alternative, the subassembly 4 (and subassembly 6 to be described below) may be formed of metal castings without welds according to a given implementation. In this case, the bores 22 and 26 are optional for use when welds are desired.

In FIG. 4, a portion 45 of head 10' and a portion 47 of head 12' extend beyond front wall 14. These portions abut the front wall 46 of the subassembly 6 casing member 38 in the closed state, FIG. 1. The width sides of these heads may abut the side wall 48, FIG. 3 of the casing member 38, FIG. 3, in the closed state, FIGS. 1, 1*a* and 2. In the alternative, they may be spaced therefrom.

Figure 3:
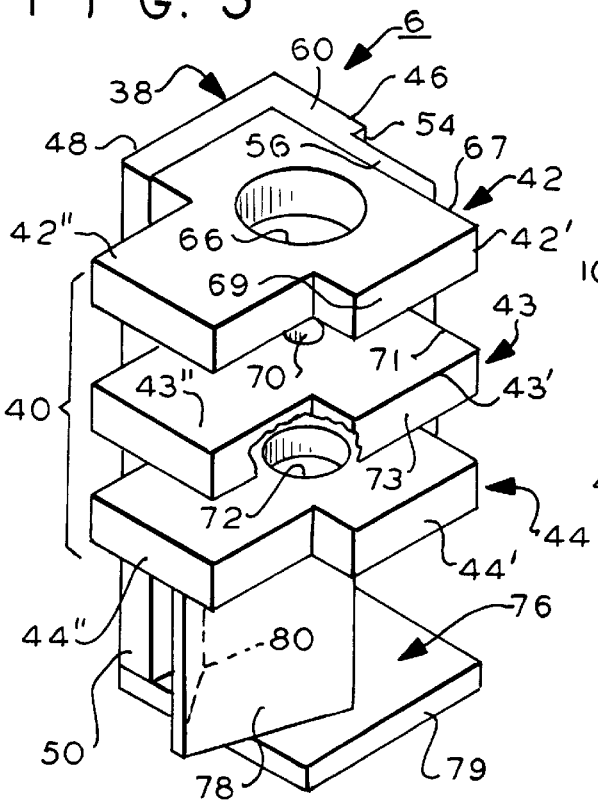
FIG. 3 is an isometric view interior view partially in section of the right hand casing member portion of the device of FIG. 1 and associated locking keeper elements attached thereto.

Subassembly 6, FIG. 3, includes an L-shaped casing member 38 and an aligned array 40 of preferably three T-shaped hasp locking keeper elements 42, 43 and 44. In the alternative, fewer or more than three such locking keeper elements may be used according to a given implementation. The casing member 38 may be right angle ⅜ inch (9.5 mm) thick sheet steel. Member 38 has a front wall 46 and a lateral side wall 48. The side wall 48 has a portion 50 which depends below the lower edge 51 of the front wall, FIG. 5. The side walls 16 and 48 of the two subassemblies 4 and 6 in the closed state of FIGS. 1 and 1*a* form a chamber 52 therebetween. The front wall 46 and the side wall 48 are each preferably rectangular. They may in the alternative be other shapes or be formed as a curved cylindrical or semi-spherical integral continuous wall with the member 8 according to a given implementation.

Figure 5:
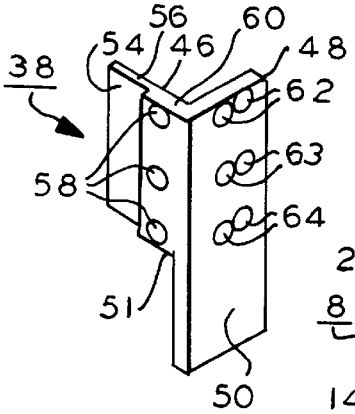
FIG. 5 is an isometric exterior view of the casing member of FIG. 3.

The casing member 38 front wall 46, FIG. 5, is formed with a rectangular recess 54 which extends for the length of the wall 46 and which is complementary to recess 20, the two front walls interengaging at these recesses. The casing member 38 front wall 46 portion 56 at the recess 54, FIGS. 1 and 1*a*, slides into the recess 20 of member 8 wall 14 and the slot formed thereby with the locking keeper elements 10 and 12.

The front wall 46, FIG. 5, preferably has three optional axially aligned through-bores 58. The bores 58 may be one half inch diameter (12.7 mm) in the thicker wall portion 60 next to the recess 54 for use in a welded embodiment. The side wall 48 has three adjacent optional pairs of through-bores 62, 63 and 64 of the same diameter as bores 58 also for use in a welded embodiment. The bores 62 are in one plane with the upper one of bores 58, the bores 63 are in a plane with intermediate bore 58 and the bores 64 are in a third parallel plane with the lowermost of bores 58.

Locking keeper elements 42, 43 and 44, FIG. 3, are preferably the same in thickness and in profile peripheral dimensions as the keeper elements 10 and 12, FIG. 4, and may be one half inch (12.7 mm) thick sheet steel. The keeper element 42 has a transverse cross head 42' from which a tongue projection 42" extends normal thereto forming a T shape. The tongue projection 42" may be 1.5 inches wide× 1.25 inches deep (3.8 cm×3.2 cm). The cross head 42' may be 2.5 inches across×1.5 inches deep (6.4 cm×3.8 cm).

The cross head 42' has a central circular through-bore 66. Bore 66 diameter is preferably enlarged with respect to the diameter of the bolt seal 5 head 68, FIG. 9, so that the bolt head 68 may pass therethrough (FIG. 1*a*). The bore 66 is axially aligned with the slots 30 and 34 of keeper elements 10 and 12, FIG. 4, in the closed state, FIG. 1*a*. The head 42' longitudinal dimension, FIG. 3, abuts the inner surface of the casing member 38 front wall 46. A portion 67 of the head 42' longitudinal dimension extends beyond the front wall 46. Portion 67 may abut the casing member 8 front wall 14, FIG. 4, and the head 42' width side 69 may abut the casing member 8 side wall 16 in the closed state, FIGS. 1, 1*a* and 2. In the closed state, the keeper elements 10, 12, 42, 43 and 44 overlie one another in stacked interdigitated aligned relation.

Figure 2:
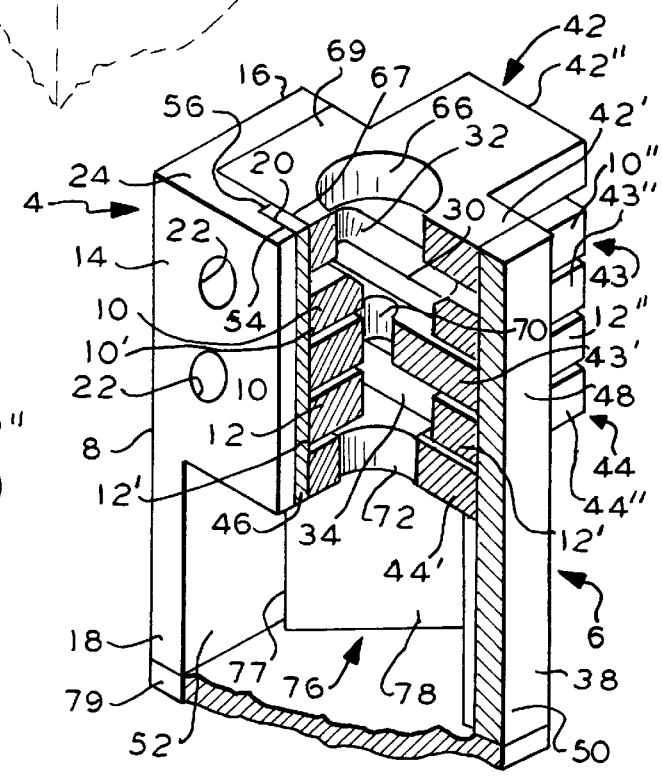
FIG. 2 is a partially in section isometric view illustrating in more detail the device of FIG. 1*a* without the bolt seal.

The keeper element 43, FIGS. 2 and 3, has a transverse cross head 43' and a normal extending tongue projection 43' identical in peripheral dimensions as keeper elements 42 and 10 (FIG. 4). The cross head 43' has a circular through-bore 70 axially aligned with bore 66. Bore 70 is preferably reduced in diameter from bore 66 and is dimensioned to receive the shaft 36 of the bolt seal 5, FIG. 9. The keeper element 43 head 43' has the same width as and abuts the side wall 48 of the casing member 38, FIG. 3.

The head 43', FIG. 3, longitudinal dimension abuts the inner surface of the casing member 38 front wall 46. A portion 71 of the head 43' is vertically aligned with head 42' portion 67 and extends beyond the front wall 46. Portion 71 abuts the casing member 8 front wall 14 and the head 43' width side 73 abuts the casing member 8 side wall 16 in the closed state, FIGS. 1, 1*a* and 2.

The keeper element 42 head 42', FIGS. 1 and 5, is preferably welded to the front wall 46 via the upper one of bores 58, which bore is filled with weld material. Similar welds at bores 62 preferably secure the head 42' to the side wall 48. The bores 62 are also filled by the welds. The optional weld filled bores preclude access therethrough by tampering tools to the interior chamber formed by the inner facing surfaces of the front wall 46 and side wall 48. In an embodiment employing castings, the bores 58 and 62–64 are omitted, the walls being uninterrupted. The aligned bores 66, 70 and 72, FIG. 2, of respective keeper elements 42, 43 and 44 form a hasp arrangement for receiving the bolt seal 5 shaft 36.

The keeper element 44 is preferably identical to keeper element 42 except that keeper element 44 has a through-bore 72 that is somewhat smaller than the diameter of bore 66 in keeper element 42. For example, the bore 66 may be 1.13 inches (2.9 cm) in diameter and the bore 72 may be 1 inch (2.54 cm) in diameter. The bore 72 is dimensioned to receive the tapered portion 74', FIG. 1*a*, of the bolt seal 5 locking body 74.

By way of example, the bore 70 may be 0.39 inches (9.9 mm) diameter. The slots 30 and 34 of keeper elements 10 and 12, respectively, FIG. 4, may be 0.39 inches wide by 1 inch long, center-to-center. The slots are preferably provided to allow for possible misalignment of the keeper elements 10 and 12 to keeper elements 42, 43 and 44 in the closed state.

The keeper element 44 is preferably welded to the casing member 38 via the lowermost bore 58, FIG. 5, in the front wall 46 of casing member 38 and via bores 64 in the side wall 48. The subassembly 6 keeper elements 42, 43 and 44 form a hasp arrangement which mate with the hasp arrangement of the keeper elements 10 and 12 of subassembly 4.

A preferably steel sheet right angle member 76, FIGS. 1 and 3, has two legs 78 and 80. Leg 80 is preferably welded to the casing member 38 side wall 48 portion depending below the lowermost keeper element 44. The member 76 is also preferably welded to the underside of lowermost keeper element 44. The distal edge 77, FIG. 2, of the leg 78 abuts or is adjacent to the side wall 16 in the closed state of FIGS. 1 and 2. Member 76 is at the rear of the chamber 52 between the side walls 16 and 48 of the two casing members in the closed state of FIG. 1. Member 76 encloses the chamber 52 rear juxtaposed with the received locked seal 5 locking body 74, FIG. 1*a*.

A sheet steel plate 79, FIGS. 1–3, is welded to the bottom edges of the casing 6 walls. Plate 79 precludes tamperers from accessing the seal 5 with tampering tools such as by hammering from the bottom in direction 39', FIG. 1*a*.

In FIG. 1, a steel plate 82 is preferably welded or otherwise fastened to a support or door 84. The door 84 displaces in directions 86. The welds (or fasteners) are not shown here and in the other joints. The side wall 16 abuts the plate 82 and is welded thereto. The plate 82 enhances the attachment of the side wall 16 to the door 84 and is optional. A second optional plate 88 is welded or otherwise fastened to the other support or door 90 which may also displace in directions 86, but in opposition to the displacement of support 84. The supports or doors 84 and 90 may be sliding or roll type doors for example. While two moving doors are shown one may be a fixed in place side wall, e.g., a rail car wall, and the other a movable door.

The subassembly 4, FIGS. 1, 1*a* and 2, is welded or otherwise affixed, e.g., bolted or riveted, to the door 84 and the subassembly 6 is fixed to the other door 90. When the doors 84 and 90, FIG. 1 are closed, in practice, in this embodiment, they do not completely close, forming a gap 92 therebetween. The tongue projections 10" and 12" of subassembly 4 project in this gap, abut the end edge 94 of door 84 and are welded thereto. The tongue projections 42", 43" and 44" of subassembly 6 project in this gap abut the end edge 96 of door 90 and are preferably welded thereto.

The presence of and the close vertical spacing of the projections to each other preclude significant access to the shaft 36 from the rear within the space enclosed by the doors 84 and 90. It is known that in certain rail cars, other gaps not shown may permit access to the interior by a relatively thin person. The shield formed by angle member 76 and the tongue projections provide further tampering resistance to access the shaft and locking body of the seal 5 from the rear.

In operation, the keeper elements subassemblies 4 and 6 mate in interdigitated overlying engagement, FIGS. 1, 1*a* and 2, when the supports or doors 84 and 90 are closed. In this closed state all of the locking keeper elements are substantially vertically aligned and abut against the opposing casing member front and side walls. Some misalignment is permitted. The front walls 14 and 46 preferably overlap at the recess 20 to provide further tamper resistance by tampering tools from the front into the chamber 52 in the presence of some misalignment of the subassemblies 4 and 6. The portion 56 of front wall 46 engages the slot formed by recess 20, preferably physically interlocking the keeper elements together in a front to rear direction.

Should the doors not close to the same location from rail car to rail car, the slots 30 and 34 in the keeper elements 10 and 12 permit some misalignment thereof in directions 86 with the bores in the keeper elements of the other subassembly 4. The keeper elements thus being misaligned may not abut the opposing casing walls in the manner shown.

The cross heads of all of the locking keeper elements 10, 12, 42, 43 and 44 are nested in alternating interdigitated relation one above the other in substantial vertical alignment in the closed state in the chamber 52 as determined by the closed state of the corresponding doors 84, 90. The cross heads substantially fill the chamber 52 as viewed from above. There may be clearance between the keeper elements and the walls of the other mating casing member in accordance with the alignment of the doors.

Once so nested, the shaft of the bolt seal 5, FIG. 9, is passed through all of the keeper element bores and slots as seen in FIG. 1*a*. The bolt head 68 has a tapered portion that engages a portion of the beveled edge 32 of slot 30, FIGS. 1*a*, 2 and 7. This engagement precludes lateral access to the shaft 36 by tampering tools adjacent to the head 68. The locking body 74 is then attached to the shaft from the bottom, FIG. 1*a*. The body 74 has a tapered portion that engages the bore 72. This engagement shields the seal 5 shaft 36 from lateral exposure external the device 2 to preclude tampering The seal 5 preferably is a releasable unit as described above and in the aforementioned U.S. Pat. No. 5,732,989 incorporated by reference herein. Other seals, e.g., one time use seals, may be employed as described in the commonly owned patents also mentioned in the introductory portion in the alternative.

The closed state of the subassemblies 4 and 6 provides a chamber 52 which is enclosed from the front of door supports 84 and 90 by the front and side walls of the subassemblies when the supports 84 and 90 are ajar as shown in FIG. 1. The upper keeper element 10 in combination with the bolt seal head 68 and the bottom most keeper element 44 in combination with the body 74 in the closed locked state preclude lateral access to the shaft 36 of the locked seal 5 between the head 68 and body 74, e.g., by a bolt cutter. The shield angle member 76 minimizes tampering with the body 74 from the rear and minimizes access to the shaft with tampering tools. Bottom plate 77 precludes access to the shaft 36 by a hammer. Hammering of the shaft from the bottom, while not opening the seal, may damage the release mechanism of the seal 5, making it inoperative.

In a second embodiment, FIGS. 10–15, device 100 comprises right and left mating abutting respective subassemblies 102 and 104. This device is for permanent use with sliding doors 106 and 108, shown in phantom, and which slide in directions 110 parallel to each other. In the alternative, one door may be a fixed non-movable wall forming a support. The doors 106 and 108 (or door and support) in the closed state in this embodiment abut at their edges at junction 112 as compared to the gap 92 provided between the closed doors 84 and 90 of FIG. 1.

It should be understood, however, that the doors 84 and 90 of FIG. 1 may also abut at their edges similar to the doors of FIG. 10. In that case, the keeper elements 10, 12, 42, 43 and 44 of the embodiment of FIG. 1 would be modified accordingly to eliminate the tongue projections thereof. These tongue projections serve to accommodate those embodiments only where the doors do not abut as shown in FIG. 1.

Figure 12:
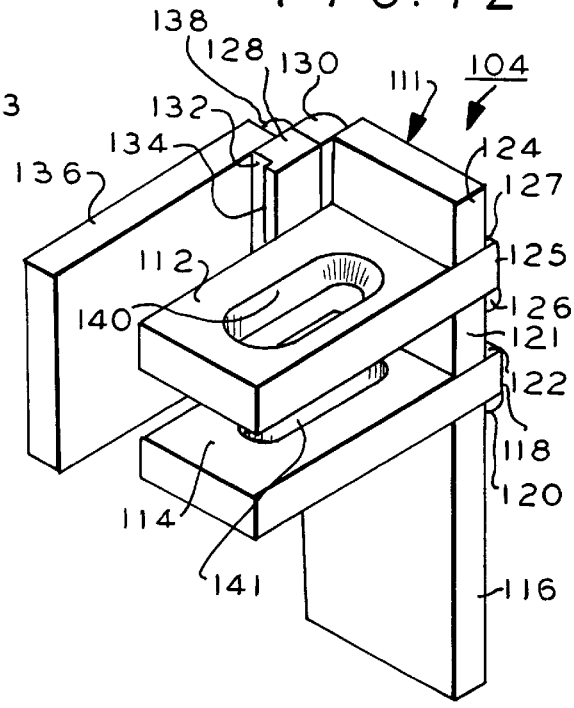
FIG. 12 is an isometric interior view of the left hand casing member portion of the device of FIG. 10 and associated locking keeper elements attached thereto.

Subassembly 104, FIG. 12, includes a generally L-shaped casing 111 and an aligned array of preferably two spaced juxtaposed preferably rectangular locking keeper elements 112 and 114. In the alternative, one or more than two such locking keeper elements may be used according to a given implementation.

The subassembly 104 casing 111 comprises a rectangular lower side wall section 116 preferably welded at an edge thereof to the underside broad surface of keeper element 114 adjacent to element edge 118 at weld 120. Edge 118 protrudes beyond the plane of the wall 116. Element 114 forms a portion of the casing 111 side wall.

A rectangular intermediate side wall section 121 is preferably welded at a section edge at weld 122 to the element 114 upper broad side surface coplanar with section 116. Keeper element 112 is preferably welded parallel to element 114 and forms a portion of the side wall of the casing 111. Element 112 is welded at weld 126 at its underside broad surface adjacent its edge 125 to an upper edge of the section 121. Edge 125 protrudes from the side wall formed by sections 116 and 121 juxtaposed with the keeper element 114 protrusion at edge 118.

A third rectangular side wall section 124 is preferably welded at a lower edge thereof at weld 127 to the upper broad side surface of keeper element 112. Section 124 is coplanar with sections 116 and 121.

A rectangular front wall section 128 is preferably welded at vertical linear seam 130 to a front edge of sections 121, 124 and an upper portion of the section 116 and to a front edge of keeper elements 112 and 114. Section 128 depends somewhat adjacent to a portion of the lower side wall section 116 for a distance about the thickness of a keeper element which are all preferably the same thickness.

Section 128 has a linear recess 132 forming a lip 134 next adjacent to the keeper elements 112 and 114. A second rectangular front wall section 136 is welded to section 128 at linear vertical seam 138 at an edge of the section 136. Seams 130 and 138 and sections 128 and 136 extend for the length of the side wall portion formed by side wall sections 121 and 124 including the thickness of the keeper elements 112 and 114 and the portion of the section 116 as seen in FIG. 13*a*.

Keeper element 112 has a chamfered through-slot 140 which is vertically axially aligned with elongated through-slot 141 in keeper element 114. Slots 140 and 142 have the same width and length dimensions and serve the same functions as the corresponding bores of keeper elements 10 and 12 of the embodiment of FIG. 2. The difference in the keeper elements is that the keeper elements 112 and 114 do not have tongue projections and also extend beyond the side wall forming a portion of the side wall of the casing 111 with the welds thereof.

In a similar context, the tongue projections of the keeper elements of the FIG. 1 embodiment may be omitted for use with doors that close abutted as shown in FIG. 10.

Figure 11:
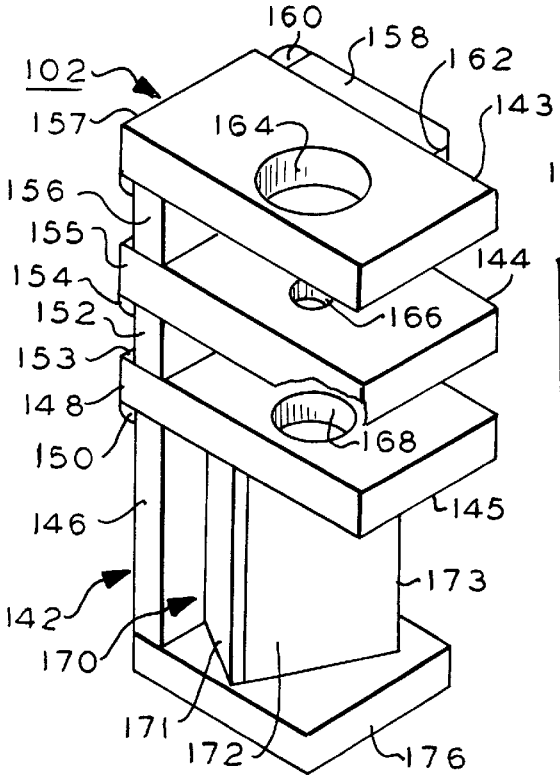
FIG. 11 is an isometric view interior view partially in section of the right hand casing member portion of the device of FIG. 10 and associated locking keeper elements attached thereto.

Subassembly 102, FIG. 11, includes a generally L-shaped casing 142 and an aligned array of preferably three spaced juxtaposed preferably rectangular locking keeper elements 143, 144 and 145. In the alternative, fewer or more than three such locking keeper elements may be used according to a given implementation.

The subassembly 102 casing 142 comprises a rectangular lower side wall section 146 preferably welded at an upper edge thereof to the underside broad surface of keeper element 145 adjacent to element edge 148 at weld 150. Edge 148 protrudes beyond the plane of the wall 146. Element 145 forms a portion of the casing 142 side wall.

A rectangular intermediate side wall section 152 is preferably welded at its lower edge at weld 153 to the element 145 upper broad side surface coplanar with section 146. Keeper element 144 is parallel to element 145 and forms a portion of the side wall of the casing 142. Element 144 is welded at weld 154 at its underside broad surface adjacent its edge 155 to an upper edge of the section 152. Edge 155 protrudes from the side wall formed by sections 156 and 152 juxtaposed with the keeper element 145 protrusion at edge 148.

A third rectangular side wall section 156 is preferably welded in similar fashion coplanar to sections 146 and 152. Section 156 is welded to and between the upper broad side surface of intermediate keeper element 144 and the lower broad side surface of uppermost keeper element 143. The keeper element 143 edge 157 protrudes from the plane of section 156 overlying the protrusions of elements 143 and 144.

A rectangular front wall section 158 is preferably welded at vertical linear weld seam 160 to a front edge of side wall sections 152, 156, an upper portion of the keeper element 145 and to a front edge of keeper elements 143 and 144. Section 158 depends to about medially of the lower keeper element 145. The elements of the two subassemblies are all preferably the same thickness and same sheet metal material. The sections 152, 156, of subassembly 102 are the same height and width as sections 121 and 124 of subassembly 104.

Front wall section 158 has a linear lip 162 next adjacent to the keeper elements 112 and 114. Lip 162 abuts lip 134 of section 128 in the closed state, FIG. 1. Keeper element 143 has a circular cylindrical through-bore 164 for receiving the head 68 of seal 5 (FIG. 9). Keeper element 144 has a through-bore 166 smaller than the diameter of bore 164 for receiving the shank 36 of seal 5. Keeper element 145 has a through-bore which has a diameter sufficiently enlarge to receive a portion of the seal body 74 tapered portion 74' as shown for example in the FIG. 1*a* embodiment. The bores of all of the keeper elements are vertically axially aligned in the closed state of FIGS. 1 and 14. The keeper elements 143, 144 and 145 elements do not have tongue projections and extend beyond the side wall sections forming the side wall of the casing 142.

The keeper elements may be ⅜ inch (9.5 mm) thick sheet steel and the side and front wall sections may be ¼ inch (6.4 mm) thick sheet steel. While the front wall and the side wall sections are preferably rectangular, they may, in the alternative, be other shapes or be formed as a curved cylindrical or semi-cylindrical integral walls according to a given implementation.

The subassemblies 102 and 104 keeper elements form a an interdigitated hasp arrangement which together receive the shank 36 of their aligned bores when closed.

A preferably steel sheet right angle member 170, FIGS. 10, 11 and 15 has two legs 171 and 172. Leg 171 is preferably welded in subassembly 102 to the casing member 142 side wall section 146 interior surface. Member 170 is welded to the underside of and depends from the lowermost keeper element 145. The distal edge 173, FIGS. 10 and 11, of the leg 172 abuts or is adjacent to the side wall section 116 in the closed state of FIGS. 10, 14 and 15. Member 170 is at the rear of the chamber 174 between the side wall sections 146 and 116 of the two casing members 111 and 142 in the closed state of FIGS. 10 and 14. Member 170 encloses the chamber 174 rear juxtaposed with the received locked seal 5 locking body 74 and protruding shaft 36 portion, FIG. 10.

A sheet steel plate 176, FIGS. 10 and 14, is welded to the bottom edges of the casing 142 side wall section 146 and member 170. Plate 176 precludes tamperers from accessing the seal 5 with tampering tools such as by hammering from the bottom in direction 177, FIG. 10.

Plates 113 and 115 may be used to bolt or weld the respective subassemblies 104 and 102 to the doors 106 and 108. Plate 113 is welded to casing 111 and plate 115 is welded to casing 142.

In operation, the keeper elements of subassemblies 102 and 104 mate in interdigitated overlying engagement, FIG. 14, when the supports or doors are closed. In this closed state, all of the locking keeper elements are substantially vertically aligned and may abut the opposing casing member front and side wall sections. The front wall section 136 overlaps the junction of the abutting lips 134 and 162 of the front wall sections 128 and 158 to provide tamper resistance by tampering tools from the front into the chamber 174 containing the keeper elements in the presence of some misalignment of the subassemblies 102 and 104. The subassembly 102 front wall section 158 engages the slot formed by front wall section 136 and the associated keeper elements of subassembly 104, interlocking the keeper elements together in a front to rear direction.

Should the doors not close to the same location from rail car to rail car, the slots 140 and 141 in the keeper elements 112 and 114 permit some misalignment thereof in directions 110 with the bores in the keeper elements of the other subassembly. The keeper elements thus being misaligned may not abut the opposing casing walls in the manner shown.

The keeper elements substantially fill the chamber 174 formed by the casing members 111 and 142 as viewed from above. There is negligible clearance between the keeper elements and the abutting walls of the other mating casing member in accordance with the alignment of the doors.

Once so nested, the shaft of the bolt seal 5, FIG. 9, is passed through all of the keeper element bores, FIG. 10. The bolt head 68 has a tapered portion that engages a portion of the beveled edge 32 of slot 140, FIG. 14. This engagement precludes lateral access to the shaft 36 by tampering tools adjacent to the head 68. The locking body 74 is then attached to the shaft from the bottom, FIG. 1*a*. The body 74 tapered portion 74' engages the bore 168 shielding the seal 5 shaft 36 from lateral exposure external the device 100 to preclude tampering.

The upper keeper element 143 in combination with the bolt seal head 68 and the bottom most keeper element 145 in combination with the body 74 in the closed locked state preclude lateral access to the shaft 36 of the locked seal 5 between the head 68 and body 74, e.g., by a bolt cutter. The shield angle member 170 minimizes tampering with the body 74 from the rear and minimizes access to the shaft with tampering tools.

FIGS. 16–23 illustrate a third embodiment of the present invention. In FIGS. 16 and 17, locking device 178 comprises a female casing 179 and a male hasp 180. The device 178 is for use with swinging hinged doors 181 and 182. In the alternative, door 182 may be fixed and only door 181 swings or rotates in directions 183. As shown door, 181 rotates in directions 184. The casing 179 is secured to door 181 by a plate 183 bolted to the door 181. Bracket 183 may also be welded to the door and to the casing 179 housing 190.

In FIG. 22, the hasp 180 may comprise ⅝ inch (16 mm) thick steel sheet. Hasp 180 has two juxtaposed parallel keeper elements 184 and 185 of like peripheral dimensions. Elements 184 and 185 extend from base plate 186. Element 184 has a through-bore 187 having a beveled edge 188 for receiving a portion of the tapered portion of the bolt seal shaft head 68 (FIG. 9). Element 185 has a through-bore 185' to accommodate the seal 5 shaft 34 in closely spaced relation. The bore 187 has a circular cylindrical portion for receiving the bolt 5 shaft 36. Two bores 189 are used to bolt the hasp 180 to the door 182. The forward corners of the elements 184 and 185 are chamfered.

The casing 179 housing 190 comprises two parallel preferably identical steel plate rectangular side walls 191 and 192, FIG. 21. Plate 183 may be welded to wall 192. Plate 183 may be ½ inch (13 mm) thick steel and walls 191 and 192 may be ¼ inch (6.5 mm) thick. A rectangular steel front plate forms front wall 193 and may be ¼ inch thick. The front and side plates are welded together at their edges by continuous seam welds (not shown).

Three juxtaposed keeper elements 194, 195 and 196 respectively form a top, intermediate and bottom keepers for the casing 179. The top and bottom elements 194 and 196 are of the same peripheral dimensions as the interior of the housing 190 chamber 198 formed by walls 191, 192 and 193. The top element is welded to the walls externally the housing interior as is the bottom element.

The intermediate element 195 front edge is welded to the front wall and the element is welded to the side walls at rear edge 197. The element 195 is foreshortened in the front to rear direction adjacent to the housing 190 rear 190' a distance of slightly greater than the thickness of plate 186 of the hasp 180, FIG. 20. This spacing is so that hasp plate 186 is totally within the chamber 198 of the housing formed by the side and front walls. Thus the rear edge 197 of intermediate element 195 is spaced interior of the plane formed by the rear edges of the side walls 191 and 192.

The top keeper element 194 has a through-bore 200 that is dimensioned so that the bolt seal 5 head 68 (FIG. 9) can pass therethrough. The bottom keeper element 196 has a through-bore 201 that partially receives the tapered portion 74' of the lock body 74 (FIG. 9). The intermediate element 195 has a through-bore 202 for closely receiving therethrough the shaft 36 of the bolt seal 5 (FIG. 23).

Plate 183 has bores 203, FIG. 21, for bolting the device female assembly 179 to door 181 (FIG. 16) and may be ½ inch (13 mm) thick steel plate.

Located in the space between side walls 191 and 192 is a right angle iron member 204. The apex of the V of the member 204 faces the rear of the assembly 179 and may be coplanar with the rear of the housing 190 at edge 190', FIG. 20. The side edges 204' of the member may be welded to the respective adjacent side walls 191 and 192 of the housing 190. The side edges in the alternative may be spaced somewhat from the respective side walls 191 and 192 or may abut these walls. Member 204 may be approximately ⅛ inch (3 mm) thick steel plate.

A bottom plate 205, which may be ¼ inch (6 mm) steel plate, is welded to the lower edges of the side walls 191 and 192 and of the member 204.

In operation, the female assembly 179 is attached to the door 181 with the housing 190 and the keeper elements 194, 195 and 196 located in a region beyond the door 181 edge 181', FIGS. 16 and 17. The male hasp 180 is positioned on door 182 so that when the door 181 is closed the hasp 180 is received in the housing 190 chamber 198. This combination is shown in FIG. 20.

With the door closed, the assembly 179 chamber 198 swings over the hasp 180 so that the keeper elements thereof interdigitate with the keeper elements of the female assembly 179 in axial alignment. Bores of the keeper elements are all axially aligned. The bolt seal 5 is then inserted and locked to the keeper elements, FIG. 23. The seal 5 head 68 is within the space beneath the top keeper element 194 at element 184. This insures the shaft 36 is not externally accessible for tampering.

The lock body 74 tapered end being inserted in the lower keeper precludes the shaft 36 from being accessible externally for tampering purposes. The robust nature of the device 178 is such that it is difficult to access the seal to break it open.

In FIGS. 24–27, a rail car 206 has a permanent fixed side wall 208 and a plug door 210. The door 210 is conventional and is opened in direction 213 by a crank mechanism 214. The door 210 fits within a door opening 212 between side wall 208 panels 208' and 208". The door 210 is secured to two spaced crank rods 216 and 218. The rods are rotatably secured to the door 210 by brackets 220 (one being shown). Each rod 216 and 218 has a crank arm 222, FIG. 27, at its ends (one end being shown).

The opposing tips of the crank arm of each rod 216 and 218 each are rotatably secured in a wheel assembly 224 (one being shown). The assembly 224 has one or more wheels 226, in practice two wheels (not shown), which ride on track 228. The assembly 224 also includes a carriage 236 which captures the wheel assembly to the track 228. The upper ends of the rods are attached to further upper wheel assemblies (not shown) in similar fashion.

When the mechanism 214 crank (not shown) is turned, gears in a gear box (not shown), rotate via connecting links (not shown) each of the rods 216 and 218 in unison. For example, rod 216 is rotated about axis 230, FIG. 27, defined by a crank arm 222 bearing in the wheel assembly 224. The rod 216 also rotates about axis 232 defined by the brackets 220 attached to the door 210. The crank arm 222 is so dimensioned such that as the rods 216 and 218 rotate, the door 210 is translated in directions 213, 213' in accordance with the direction of rotation of the rods.

Once the door 210 clears the side wall 208 exterior at the opening 212 in the side wall 208, the door 210 may then be slid in direction 234 along the track 228. The wheel assemblies are arranged to support the door as it travels along the track in conjunction with other upper tracks (not shown) and wheel assemblies. FIG. 25 shows the position of the door 210 in an open state.

When the door 210 is slid from the open state to the closed state, the door is displaced opposite to directions 213 and 234.

In FIG. 24, lock device e 238 is constructed similar to the device 178 of FIGS. 16–23. The difference may be exterior peripheral dimensions which are determined for a given implementation. The device 238 includes a hasp 240 which may be identical to hasp 180, FIG. 22. The device 238 includes a female assembly 242 which may be identical to assembly 179, FIG. 17, for example.

The housing of the assembly 242 may have one or more notches in the side walls thereof to accommodate clearance of the hasp 240 attached to side wall panel 208' as the door 210 is slid in direction 234 during opening. To fit flush over the hasp 240, the housing of the female assembly 242 may extend inwardly somewhat of the inner surface of the door 210 in direction 213', FIG. 25. This is to allow for clearances between the door 210 and the side wall 208. In this case, the housing normally might interfere with the hasp due to the housing projecting inwardly of the door 210 in direction 213' as the door is moved in direction 234.

The notches (not shown) in the housing side walls such as walls 191 and 192 permit the hasp 240 to slide through a portion of the projecting portion of the housing. Of course, the presence, absence or dimensions of such notches depend upon a given implementation.

When the door 210 is positioned juxtaposed over and adjacent to the opening 212, the female assembly 242 is aligned horizontally directly over the hasp 240. Then, as the door 210 is cranked inwardly direction 213' to the closed position, the female assembly 242 receives the hasp 240 until the keeper elements thereof are interengaged as shown in the FIG. 20 embodiment. The seal 5 is then attached and the door 210 is thus locked in place. The seal 5 is removed in this and the above embodiments by releasing the lock body 74 with the mating tool (not shown in the figures) shown in the aforementioned U.S. Pat. No. 5,732,989.

It will occur to one of ordinary skill that various modifications may be made to the disclosed embodiments. For example, welded joints are disclosed, but metal, e.g., iron, castings formed as integral units will not have such welds between the keeper elements and the casing walls.

The devices may be preferably welded to the door supports in the FIG. 2 embodiment, may be bolted as in the FIGS. 16–23 embodiment, riveted or otherwise permanently attached as desired according to a given implementation.

For example, the device 2 may be recessed into the supports or doors or formed flush with the front faces thereof. In such an embodiment, the casing members' side walls may be foreshortened or eliminated with the keeper elements recessed into the supports or doors. The front faces of the supports or doors then form the front walls of the device 2 which abut regardless the abutment of the door supports in a given implementation.

Where the supports or doors do not abut in the closed state, the keeper elements include the tongue projections which project into the gap between the closed supports. In this case the casing member side walls may be interior the supports, not essential and omitted.

The front walls of the doors or supports in this latter embodiment project into the gap in the closed state in front of the keeper elements forming the front walls of the casing members. The bolt seal locking body, however, is accessible from the front by a suitable opening in the support front face corresponding to the keeper element chamber in the device between the side walls. The relative shapes and number of the keeper elements also will depend upon a given implementation. It is intended that the disclosed embodiments be by way of illustration and not limitation. The scope of the invention is as claimed in the appended claims.

What is claimed is:

1. A seal protective and locking device for securing a door movable relative to a support and having open and closed states relative to support, the device cooperating with and being locked by a bolt seal including a shaft, a head secured to a shaft end and a locking body selectively secured to a shaft end distal the head and defining a shaft portion therebetween, said device comprising:

a casing comprising at least one casing member forming a chamber in at least said closed state and for fixed attachment to at least one of the door and support, said casing for cooperation with said at least one door and support in at least said closed state for enclosing said chamber and for precluding passage of tampering tools therethrough;

means for fixedly attaching the casing directly to said at least one of the door and support;

a first locking keeper element secured to the casing and having a first bolt seal receiving aperture;

a second locking keeper element having a second bolt seal receiving aperture for being secured to the other of said door and support, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft; and means for fixedly attaching the second keeper element directly to the other of said at least one of the door and support.

2. The device of claim 1 wherein the casing has two opposing side walls and a front wall, the side walls each having a portion depending beneath the lowermost of said keeper elements forming a chamber portion therebetween, further including a shield member in said chamber portion secured to at least one of said side walls, casing and first keeper element, said shield member for shielding the rear of the chamber portion opposite the plane of the front wall from penetration therethrough by said tampering tools.

3. The device of claim 1 wherein said door and support in the closed state exhibit a gap therebetween, said locking keeper elements each including a tongue projection in overlying relation in said closed state for extending in the gap.

4. The device of claim 1 wherein the casing comprises first and second mating casing members each for being secured to a different one of said door and support, the casing members forming said chamber when mated in the closed state, the first keeper element being secured to the first casing member and the second keeper element being secured to the second casing member.

5. The device of claim 4 wherein the first and second casing members form corresponding first and second portions of said chamber, only the first keeper element being located in the first chamber portion in the open state and only the second keeper element being located in the second chamber portion in the open state.

6. The device of claim 4 wherein the casing members and locking keeper elements are metal, said casing members each having a plurality of weld apertures therethrough aligned with and corresponding to each locking element, and a weld joint in each weld aperture between each of the keeper elements and the respective corresponding casing member.

7. The device of claim 1 wherein the casing comprises first and second mating casing members, each member for being secured to a different one of said door and support, the first and second casing members each including a front wall section, the front wall sections of the members including portions which overly each other in the closed state.

8. The device of claim 1 including a plurality of said first and second locking keeper elements, the second locking keeper elements for being between at least a portion of the first keeper elements in the closed state of the door and support, the seal receiving apertures of the second keeper elements each comprising a slot aligned in overlying relation with each other and with the seal apertures in the first keeper elements.

9. The device of claim 4 including a plurality of said first and a plurality of said second keeper elements, the first elements being secured to said first casing member, the second elements being secured to the second casing member, each said casing members having a side wall, each said side wall comprising a plurality of side wall sections alternating with and secured to the keeper elements of that casing member to form a continuous side wall with said alternating keeper elements.

10. The device of claim 9 wherein the keeper elements at each side wall project beyond the side wall sections.

11. The device of claim 7 wherein the keeper elements each have a front edge facing a front wall section of the corresponding casing member, the front wall section of one casing member having a portion spaced from the front edge of its corresponding keeper elements forming a slot therebetween, said slot for receiving the front wall section of the other casing member in said closed state.

12. The device of claim 1 wherein the casing comprises a front wall and opposing side walls forming said chamber, said first keeper element being secured in said chamber, further including third and fourth keeper elements secured to the casing, each element with a seal receiving aperture, the third element forming a top wall and the fourth element forming a bottom wall of said chamber, said second keeper element for being received between two of the first, third and fourth keeper elements with all said apertures being aligned in said closed state of said support and door.

13. The device of claim 12 wherein the second keeper element further comprises a U-shaped hasp with a pair of aligned keeper elements and respective aligned bolt seal apertures, said pair of aligned keeper elements for receiving the first keeper element therebetween in said closed state.

14. The device of claim 1 wherein the first keeper element seal receiving aperture has a chamfered ingress portion for receiving a portion of said seal head and the second keeper element has an enlarged seal receiving aperture for receiving a portion of the locking body.

15. The device of claim 12 further including a fifth keeper element with a bolt seal receiving aperture and secured to the second keeper element with the apertures thereof aligned, said second and fifth elements for receiving the first element therebetween with said apertures aligned in said closed state.

16. The device of claim 15 wherein said keeper elements together are in closely spaced relation to substantially fill said casing chamber in said closed state.

17. The device of claim 15 wherein the first element seal receiving aperture is dimensioned to pass the seal head therethrough, said second element being next adjacent to said first element, said second bolt receving aperture for receiving a portion of said seal head therein.

18. The device of claim 15 wherein the fourth keeper element has a seal receiving aperture dimensioned to receive a portion of the locking body therein.

19. A bolt seal lock device for locking a set of relatively movable supports, said seal including a shaft, a head secured to a shaft end and a locking body selectively secured to a shaft end distal the head defining a shaft portion therebetween, said device comprising:

first and second mating casing members having open and closed states, each casing member having a front wall and a side wall, said front walls each with at least a portion for selective complementary overlying engagement with one another in the closed state to form a tampering tool impervious joint, said side and front walls for providing a chamber therebetween in said closed state, each casing member for fixed attachment to a corresponding respective different one of said supports, said front and side walls in the closed state sufficiently enclosing the chamber so as to preclude passage of tampering tools to said chamber therethrough; and a plurality of first locking keeper elements secured to the first casing member and a plurality of second locking keeper elements secured to the second casing member for overlying each other in said chamber in the closed state in interdigitated relation, said overlying locking keeper elements each having a seal receiving aperture therethrough aligned for receiving said seal shaft, the head and locking body for selective locking said overlying keeper elements to said received shaft such that said received shaft portion in the chamber is inaccessible to said tampering tools through said front and side walls and through the locking keeper elements at said head and locking body ends of the shaft.

20. The device of claim 19 wherein said supports in the closed state exhibit a gap therebetween, said locking keeper elements each including a tongue projection for extending between said supports in the gap, said projections for being secured to the same support as the corresponding casing member to which those keeper elements are secured.

21. The device of claim 19 wherein the chamber has a rear face at a chamber lower portion beneath the lowermost of said elements and including a shield member secured to the casing in said chamber lower portion for shielding the chamber portion rear face between said side walls from tampering tools.

22. The device of claim 19 wherein the keeper elements are in a further chamber portion and are arranged to substantially enclose the further casing chamber portion from the rear opposite the front walls.

23. A seal protective and lock device for attachment to relatively movable first and second supports having open and closed states for use with a bolt seal having a shaft, a head at one shaft end and a locking body secured to the other shaft end defining a shaft portion therebetween for locking the supports in the closed state, said device comprising:

a casing having front and side walls forming a chamber for attachment to the first support;

first, second and third keeper elements secured to the casing and having aligned bolt receiving apertures, the first element forming a chamber top wall, the second element forming a chamber bottom wall and the third element being located in the chamber between the first and second elements; and at least one further keeper element with a bolt seal receiving aperture for attachment to the second support, said at least one further keeper element for being received in the chamber in the closed state of the supports and juxtaposed with the first, second and third keeper elements with said seal receiving apertures aligned;

said elements and casing being arranged so that the received seal shaft portion is totally enclosed in said chamber by said front and side walls and keeper elements;

the first element having a seal receiving aperture for passing the seal head therethrough, the at least one further keeper element comprising a plurality of keeper elements, one of the plurality of elements for being next adjacent to said first element in the closed state for receiving a portion of said seal head, said second element for receiving a portion of said locking body.

24. A seal protective and locking device for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween, said device comprising:

a casing comprising first and second metal mating casing members each for being fixedly secured to a different one of said door and support, the casing forming a chamber in at least said closed state, said casing for cooperation with said door and support in at least said closed state for precluding passage of tampering tools therethrough;

a first metal locking keeper element secured to the first casing member and having a first bolt seal receiving aperture;

a second metal locking keeper element having a second bolt seal receiving aperture secured to the second casing member, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft;

said casing members each having a plurality of weld apertures therethrough aligned with and corresponding to each locking element, and a weld joint in each weld aperture between each of the keeper elements and the respective corresponding casing member.

25. A seal protective and locking device for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween, said device comprising:

a casing comprising first and second mating casing members, each member for being fixedly secured to a different one of said door and support, the casing members forming a chamber in at least said closed state, said casing for cooperation with said door and support in at least said closed state precluding passage of tampering tools therethrough;

a first locking keeper element secured to the first casing member and having a first bolt seal receiving aperture;

a second locking keeper element having a second bolt seal receiving aperture and being secured to the second casing member, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft;

the first and second casing members each including a front wall section, the front wall sections of the members including portions which overly each other in the closed state.

26. A seal protective and locking device for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween, said device comprising:

a casing comprising first and second mating casing members each for being fixedly secured to a different one of said door and support, the casing forming a chamber in at least said closed state, said casing for cooperation with said door and support in at least said closed state for precluding passage of tampering tools therethrough;

a plurality of first locking keeper elements secured to the first casing member and having a first bolt seal receiving aperture;

a plurality of second locking keeper element having a second bolt seal receiving aperture secured to the second casing member, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft;

each said casing members having a side wall, each said side wall comprising a plurality of side wall sections alternating with and secured to the keeper elements of that casing member to form a continuous side wall with said alternating keeper elements.

27. A seal protective and locking device for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween, said device comprising:

a casing comprising at least one casing member forming a chamber in at least said closed state and for fixed attachment to at least one of the door and support, said casing for cooperation with said at least one door and support in at least said closed state precluding passage of tampering tools therethrough;

a first locking keeper element secured to the casing and having a first bolt seal receiving aperture;

a second locking keeper element having a second bolt seal receiving aperture for being secured to the other of said door and support, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft;

the casing comprising a front wall and opposing side walls forming said chamber, said first keeper element being secured in said chamber, further including third and fourth keeper elements secured to the casing, each element with a seal receiving aperture, the third element forming a top wall and the fourth element forming a bottom wall of said chamber, said second keeper element for being received between two of the first, third and fourth keeper elements with all said apertures being aligned in said closed state of said support and door; and a fifth keeper element with a bolt seal receiving aperture secured to the second keeper element with the apertures thereof aligned, said second and fifth elements for receiving the first element therebetween with said apertures aligned in said closed state;

said keeper elements being in closely spaced relation to substantially fill said casing chamber in said closed state.

28. A seal protective and locking device for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween, said device comprising:

a casing comprising at least one casing member forming a chamber in at least said closed state and for fixed attachment to at least one of the door and support, said casing in cooperation with said at least one door and support in at least said closed state precluding passage of tampering tools therethrough;

a first locking keeper element secured to the casing and having a first bolt seal receiving aperture;

a second locking keeper element having a second bolt seal receiving aperture for being secured to the other of said door and support, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft;

the casing comprising a front wall and opposing side walls forming said chamber, said first keeper element being secured in said chamber, further including third and fourth keeper elements secured to the casing, each element with a seal receiving aperture, the third element forming a top wall and the fourth element forming a bottom wall of said chamber, said second keeper element for being received between two of the first, third and fourth keeper elements with all said apertures being aligned in said closed state of said support and door; and a fifth keeper element with a bolt seal receiving aperture and secured to the second keeper element with the apertures thereof aligned, said second and fifth elements for receiving the first element therebetween with said apertures aligned in said closed state;

the third element seal receiving aperture being dimensioned to pass the seal head therethrough, said second element being next adjacent to said third element, said second element bolt receiving aperture for receiving a portion of said seal head therein.

29. A seal protective and locking device for securing a door movable relative to a support and having open and closed states relative to the support, the device cooperating with and being locked by a bolt seal including a shaft, a head secured to a shaft end and a locking body selectively secured to a shaft end distal the head and defining a shaft portion therebetween, said device comprising:

a casing comprising at least one casing member forming a chamber in at least said closed state and for fixed attachment to at least one of the door and support, said casing for cooperation with said at least one door and support in at least said closed state precluding passage of tampering tools therethrough;

a first locking keeper element secured to the casing and having a first bolt seal receiving aperture;

a second locking keeper element having a second bolt seal receiving aperture for being secured to the other of said door and support, said second keeper element for selectively overlying the first keeper element in said chamber in the closed state of said door and support such that the bolt seal apertures are aligned for receiving said seal shaft, the head and locking body for selective locking of said overlying locking keeper elements to said shaft, said keeper elements and casing being arranged so that the shaft portion is enclosed in the chamber and is inaccessible through said casing and through said locking keeper elements at the head and locking body ends of the shaft;

said door and support in the closed state exhibiting a gap therebetween, said locking keeper elements each including a tongue projection in overlying relation in said closed state for extending in the gap.

* * * * *